United States Patent [19]

MacDonald

[11] 4,326,326

[45] Apr. 27, 1982

[54] METHOD OF MAKING METAL GOLF CLUB HEAD

[75] Inventor: Paul MacDonald, Villanova, Pa.

[73] Assignee: The Merion Corporation, Villanova, Pa.

[21] Appl. No.: 167,330

[22] Filed: Jul. 9, 1980

[51] Int. Cl.[3] ..... B23P 19/00

[52] U.S. Cl. ..... 29/428; 29/527.5; 164/35; 164/45; 273/167 F; 273/169

[58] Field of Search ..... 29/428, 526 R, 423, 29/424, 527.5; 164/34, 35, 36, 45; 273/194 A, 194 B, 167 F, 169

[56] References Cited

U.S. PATENT DOCUMENTS

| | | | |
|---|---|---|---|
| 922,444 | 5/1909 | Youds | 273/169 |
| 1,622,864 | 3/1927 | Findlay | 273/169 |
| 1,666,174 | 4/1928 | Holland | 273/169 X |
| 2,420,851 | 5/1947 | Zahn et al. | 164/35 |
| 3,132,388 | 5/1964 | Grant | 164/36 |
| 3,256,574 | 6/1966 | Lirones | 164/35 X |
| 3,305,358 | 2/1967 | Lirones | 164/34 X |
| 4,160,313 | 7/1979 | Radford | 29/526 R X |

FOREIGN PATENT DOCUMENTS

| | | | |
|---|---|---|---|
| 371974 | 5/1932 | United Kingdom | 273/167 F |
| 440379 | 12/1935 | United Kingdom | 273/167 F |

*Primary Examiner*—Charlie T. Moon

*Attorney, Agent, or Firm*—Howson and Howson

[57] ABSTRACT

An integral stainless steel golf club head having a lead insert positioned directly behind the center of the intended striking surface of the club head is provided by using a "lost wax" procedure to mold an internally screwthreaded recess in the rear surface of the club head, into which a correspondingly threaded lead insert of selected weight and length is inserted.

2 Claims, 17 Drawing Figures

FIG. 1.
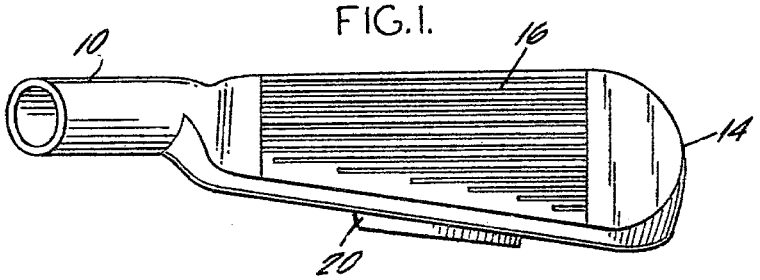
FIG. 4.
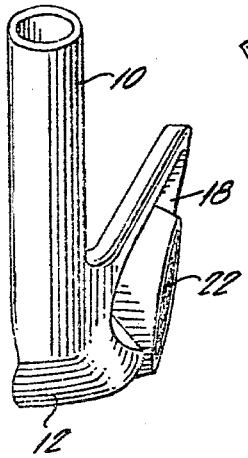
FIG. 2.
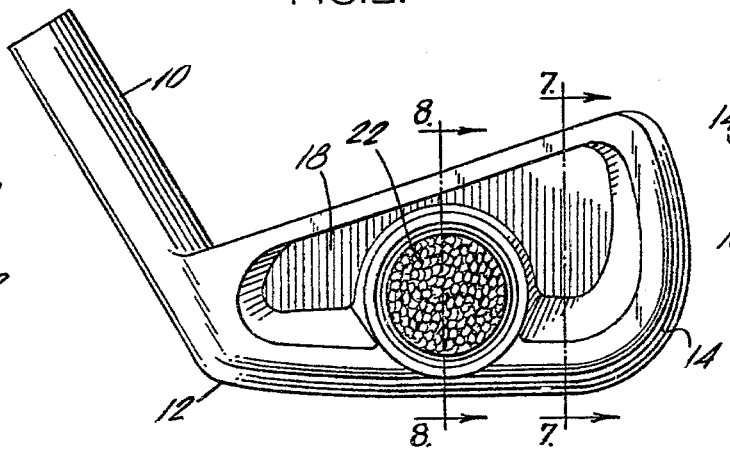
FIG. 5.
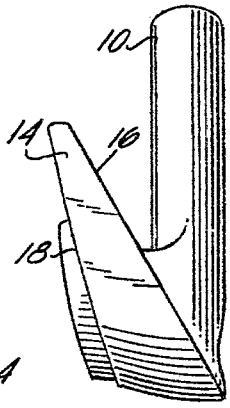
FIG. 3.
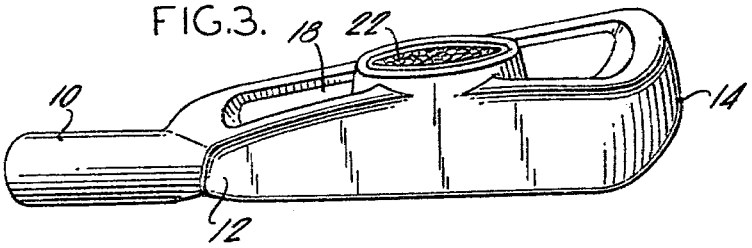
FIG. 6.
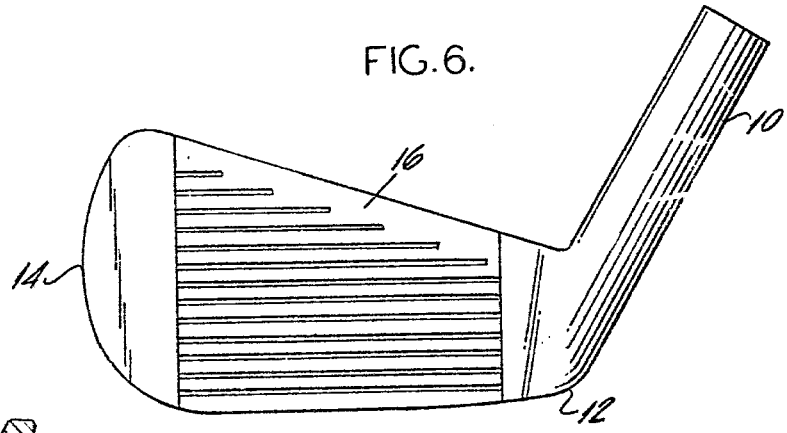
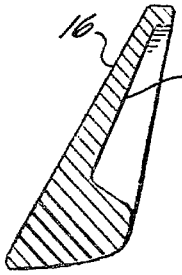
FIG. 7.
FIG. 8.
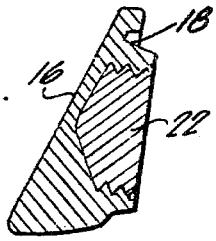

Fig. 12.
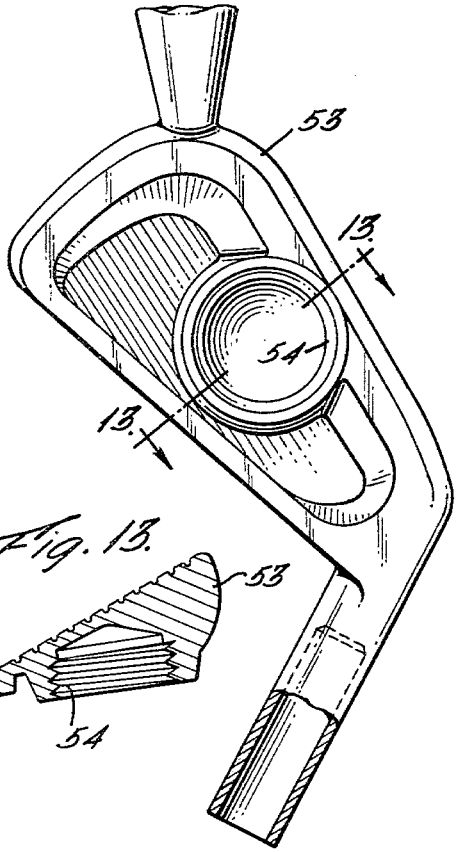
Fig. 13.
Fig. 9.
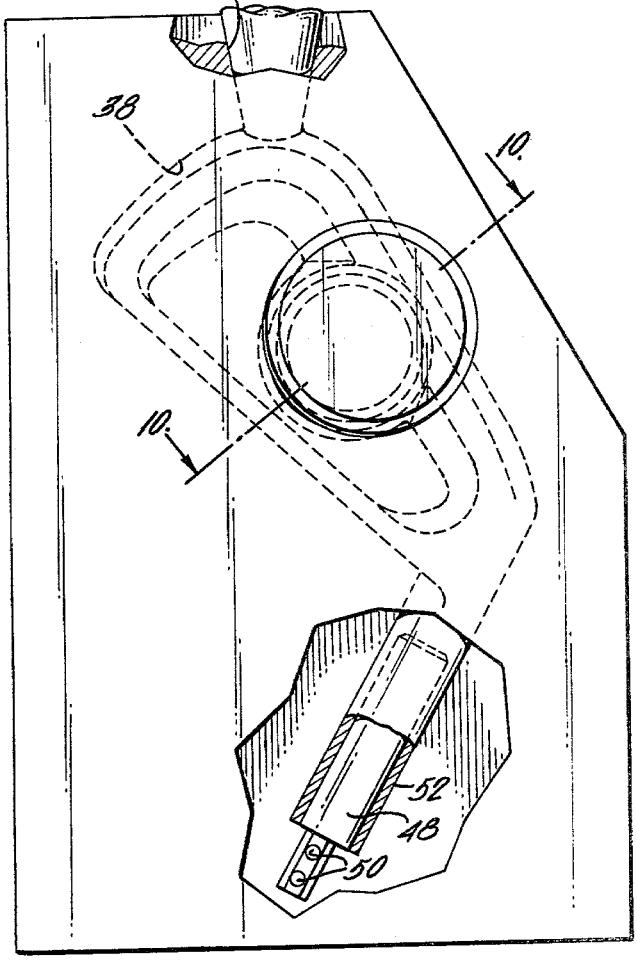
Fig. 10.
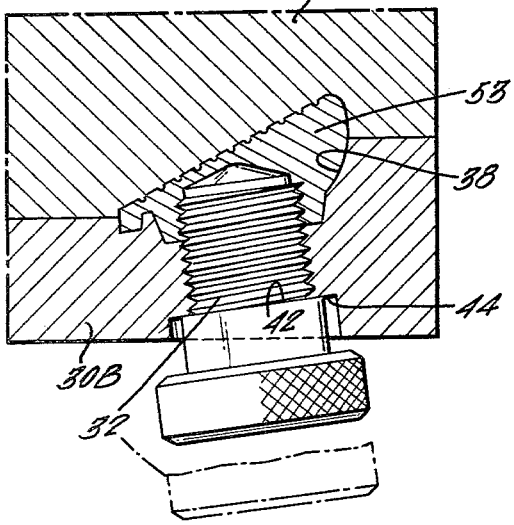
Fig. 11.
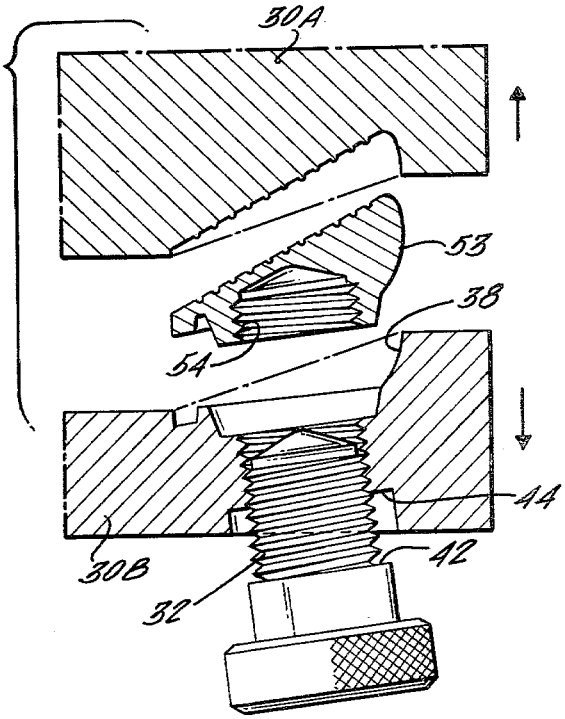

METHOD OF MAKING METAL GOLF CLUB HEAD

BACKGROUND OF THE INVENTION

The invention relates to methods for making heads for golf clubs of the "iron" type, as differentiated from so-called "woods" or "putters".

To fairly reflect the skill of the golf player, an "iron" club, if struck correctly, should result in consistent and predictable direction, distance and loft in the flight of the ball, should be capable of producing backspin on the ball for control and stoppage on the green, should produce a consistent amount of fade from left to right, or draw from right to left, when so struck as to produce such action, and should minimize the chance of the phenomenon known as "flyers". Also, it is desirable that the iron club be forgiving of small human errors, such as striking the ball on a portion of the club face up to a half inch from the desired striking center toward the toe or heel of the club, or up to about a quarter inch above or below the optimum striking point. However, to fairly represent the ability of the golfer, the club should require that a good swing be made in striking the ball, without any unfair advantage due to special gimmicks, gaskets, springs, etc. built into the golf club.

Existing "iron" clubs cast or forged of hard steel have exhibited many of the disadvantages referred to above. For example, modern "iron" clubs result in the following errors based on machine tests and many field tests:

1. The final rest positions of golf balls hit exactly on the center of the striking face of a #5 iron vary laterally by as much as about 24 feet, and by as much as 18 feet in distance from the striker.

2. A perfect swing, applied to hit the ball one-half inch toward the toe of the face from the optimum striking point, will cause the ball to come to rest as much as 40 feet to the right and 30 feet short of the position for perfect center hits with the same #5 iron and same swing.

3. Hits made a half inch toward the heel of the club face from the ideal striking spot are similarly off-line to the left.

In addition, difficulty is often experienced in maneuvering the ball with control of its flight; also, "flyers" sometimes occur in which a clean hit results in no backspin on the ball, and it is quite common to experience a "poor feel" in striking the ball, or sting or shock from mishits with inherent tendency to injure the hands or wrists.

It has been shown that modern "iron" golf clubs made of hard steel, and used to strike high-compression golf balls, result in a time of contact at impact that is an infinitesimal fraction of a second. It is known that control of the golf ball flight is improved if contact between the iron club face and the ball is prolonged. This allows the technique of the golfer's swing to impart spin to the ball and, importantly, it permits the maximum amount of potential energy of the iron club head to be transferred to the ball to get maximum distance.

The rules of golf of the United States Golf Association do not permit a resilient or yieldable club face, springs, or movable parts or gadgets to accomplish this. Soft malleable forged steel used for the clubs head does improve the results mentioned above, but has other disadvantages.

SUMMARY OF THE INVENTION

In a device made according to the present invention, means are provided within the club head which soften the impact of the club face against the ball by absorbing the shock of impact, and release the energy to the ball during a contact interval of longer duration than with the usual golf club head. The means for accomplishing this desirable result comprise a lead insert secured within the club head and centered behind the point on the striking face where contact with the ball is ideally to be made. Preferably this lead insert has a large depth, or length, transverse to the striking surface, so as to extend from the rear of the club forwardly to a position just behind the back of the striking face of the club head. To accommodate such an insert of substantial depth, it is preferable to extend the rear part of the club head rearwardly, in the area which receives the insert, but in other respects the club head may be of substantially conventional configuration.

In addition to providing maximum depth of insert, the arrangement for receiving the lead insert preferably permits the lead insert to be mechanically secured once it is inserted, and permits use of inserts of any of various weights between, for example, 36 and 42 grams, to be used to adjust for different swing weights.

1. More consistent distance and direction - #5 iron test-machine hits vary only about 9 feet inlength and about 12 feet in width.

2. Mis-hits one-half inch toward the toe are substantially as straight and only about six feet shorter than center hits; mis-hits toward the heel produce similar results.

3. Spinning and maneuvering of the ball in flight are achievable with more control.

4. Because more spin can be obtained, the chance of producing "flyers" is reduced.

5. Typically, more distance is obtained.

6. A softer, more solid feel is obtained, without substantial sting, torsion or twisting in the hands.

7. Injury or fatigue of the hands and wrists is minimized due to the reduced shock.

8. Custom selection of swing weight is accomplished without requirement of adding lead to the hosel.

While it is considered possible that these improved results from the use of the lead insert may simply be due to the lead acting as a shock absorber, it is believed that lead has some more subtle, peculiar and unique qualities, as indicated by the following phenomena. In ballistics, bullets normally must be made of lead; lead additives must be mixed with high octane gasoline to absorb the energy of explosion throughout the downward stroke of the piston, whereby the combustion-chamber pressure curve is flattened out over a longer period of time by such addition of lead; and instrument used to measure the power of impact force of a bullet fired from a gun incorporates a bar of lead of prescribed length for more accurate measurement by electronic devices, because impact energy pressure waves are said to pass through lead at one-quarter the velocity of any other known material; lead sheet is also used in acoustics for absorbing sound energy; and pro golfers have used lead tape for years on their golf clubs, not really knowing the source of the advantage except that it seemed to work.

It has also been common for many years to use lead for the purpose of weighing the club head to achieve the desired swing weight of the club. Small amounts of lead have typically been added in the heel of the club in the case of irons, and adjacent the sole plate in the case of woods, to produce a desired club head weight. There have also been attempts to make golf clubs from combinations of lightweight material such as aluminum, in which lead was also employed but only for the purpose of weighing or balancing the club.

It is an object of this invention to provide a new and useful method of making a club head of the "iron" type.

Another object is to provide such a method which produces a threaded recess or cavity in the clubhead, in a manner which results in one or more of the following advantages: a lead insert of selected proper weight and size can be located in the recess in a position where it will have maximum helpful effect on the impact with the golf ball; it provides an acceptable decorative design in keeping with the commercial configuration of the club head; it permits the insertion of lead inserts of different weights to adjust for various club swing weights thereby to match all clubs in a complete set, and to balance sets to fit the needs of different golfers; it permits fastening of the lead insert in place mechanically, in a secure and permanent manner; and it provides and makes possible a practical, simple and economical manufacturing process.

In accordance with the invention, the club head is made by a "lost wax" process which, in an intermediate step thereof, produces a wax-like image of the final golf club head, less the lead insert. In the formation of this wax-like image, an externally-threaded protrusion is provided on a split mold assembly in a position such that the threaded portion of the protrusion extends into the mold cavity from the rear side thereof forwardly to a position adjacent the rear of the front surface of the wax-like image, thereby to form an internally-threaded recess extending from the rear surface of the wax-like image toward the front surface thereof. The final golf club head is a replica of the wax-like image, and therefore contains the molded, internally-threaded recess for receiving the lead insert, into which the selected lead insert is thereafter inserted by a screwing action. The outer surface of the lead insert may then be struck or tapped to distort it sufficiently to hold it securely in its inserted position.

Preferably, the wax-like image of the golf club is produced by providing a split mold assembly which, when assembled for casting, defines a first mold cavity of the same configuration as the desired golf head. This cavity is filled with a molten wax-like material, and thereafter cooled to solidify the wax-like material in the form of the wax-like image of the golf club head. The split mold assembly is thereafter separated to release the wax-like image from the mold assembly, and the wax-like image thereafter covered with a frangible solid coating; this coating is preferably provided initially in liquid form, and thereafter permitted to solidify. After this, the wax-like material within the coating material is melted and withdrawn, to leave a second mold cavity within the coating material of the same configuration as the desired golf club head, and this second mold cavity is thereafter filled with molten metal. Upon cooling of the molten metal therein, it solidifies to form the ultimate golf club head, and the frangible coating is removed therefrom as by striking it repeatedly to cause it to crack and peel off. The threaded protrusion used during the casting of the wax-like image is preferably in the form of a thick, threaded bolt or screw, screwed into corresponding threads provided in the original split mold, and extending into the first mold cavity, and the lead insert is preferably provided with external threads matching the molded threads in the interior of the molded recess.

The result is an integral metal golf club, preferably of stainless steel, having a threaded recess for receiving the lead insert, which insert then extends from the rearmost portion of the golf club head to an interior position adjacent the rear of the front striking surface and directly behind the desired center of striking, whereby the above-described advantages are attained in a particularly simple and economical manner.

BRIEF DESCRIPTION OF FIGURES

These and other objects and features of the invention will be more readily understood from a consideration of the following detailed description, taken with the accompanying drawings, in which:

FIGS. 1—6 are perspective views of a golf club head made and assembled according to the present invention, as seen from the top, the rear, the bottom, the heel end, the toe end and the front, respectively;

FIG. 7 is a sectional view taken along lines 7—7 of FIG. 2;

FIG. 8 is a sectional view taken along lines 8—8 of FIG. 2;

FIG. 9 is a side view of an assembled split mold as it is used for casting a wax-like image of the golf club head according to one preferred embodiment of the invention;

FIG. 10 is a fragmentary sectional view taken along lines 10—10 of FIG. 9;

FIG. 11 is a fragmentary sectional view similar to that of FIG. 10, but with the threaded protrusion screwed back from the mold cavity, and the halves of the split mold separated to release the cast wax-like image of the golf club head;

FIG. 12 is a side elevation of the wax-like image of the golf club head after removal from the mold;

FIG. 13 is a sectional view taken along lines 13—13 of FIG. 12;

DETAILED DESCRIPTION OF SPECIFIC EMBODIMENTS

Figure 14:
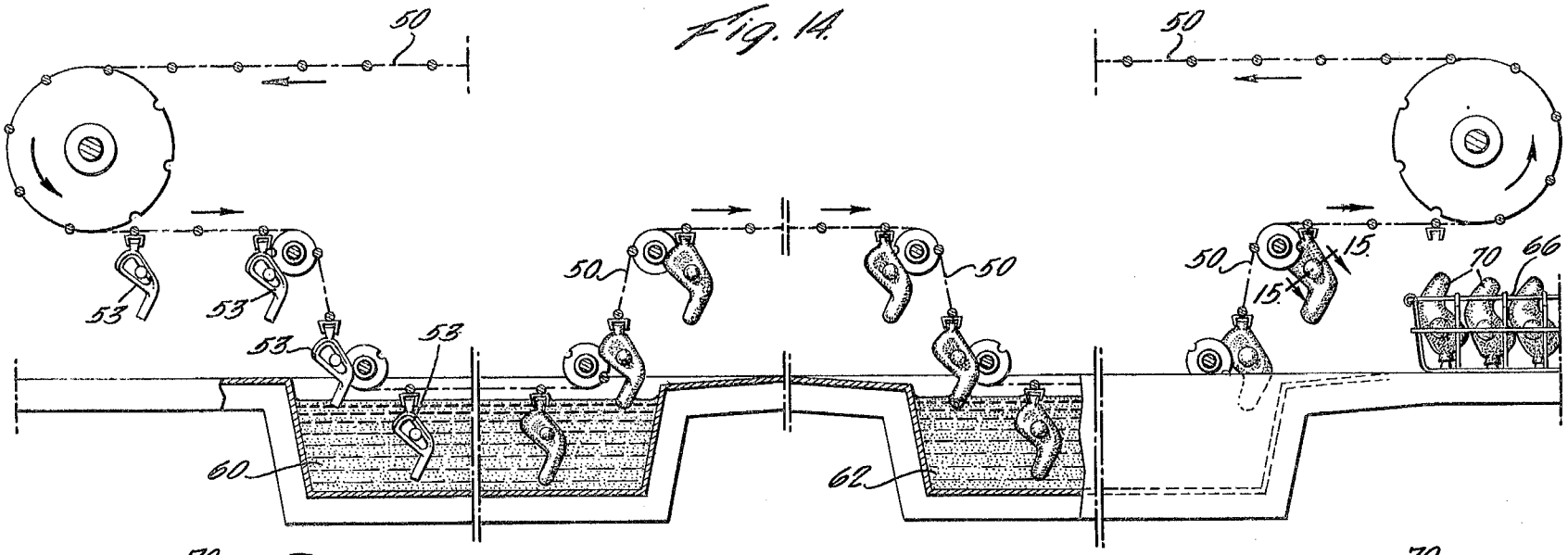
FIG. 14 is a schematic representative of an apparatus for coating the wax-like image of the golf club head.

Referring now to the embodiment of the invention shown in the drawings by way of example only, FIGS. 1—8 show a golf club head of a type which can be made by the method of the invention, comprising a hollow hosel 10, a heel portion 12, a toe portion 14, a scored front hitting face 16, and a rear face 18 comprising a rearwardly extending boss or receptacle 20 internally threaded to receive a correspondingly threaded lead insert or plug 22, screwed into it and slightly peened as with a hammer or other instrument to secure it in position once inserted into the corresponding threads of the golf club head. As can be seen especially clearly in FIG. 8, the lead insert 22 is positioned directly behind the desired hitting center of the front face of the club, and extends from the rear face forwardly to a position adjacent the interior side of the hitting face 16. It thus lies directly and closely behind the area of the front face of the golf club at which the golf ball is intended to be struck, with the advantages described hereinbefore. The remainder of the drawings illustrate one preferred form of method for making such golf club head, with lead insert.

Referring now particularly to FIGS. 9–11, a split mold assembly is provided comprising front mold half 30A, rear mold half 30B, and a threaded protrusion in the form of a bolt 32 which is screwed into corresponding threads extending through rear mold half 30B so that the forward end of the bolt extends into the mold cavity 38 between the front and rear mold halves and near to the inner opposite face of the mold cavity, as shown particularly clearly in FIG. 10. The mold cavity 38 has the configuration desired for the final golf club head. The mold is preferably split along a generally vertical plane which divides the hosel and the remainder of the club into roughly equal halves. As shown in FIG. 9, the upper end of the mold assembly is provided with a suitable filling sprue 39 extending from the exterior to the internal mold cavity 38 to communicate therewith and, if desired, venting openings (not shown) may also be provided communicating from the exterior to the mold cavity for escape of air during filling. The bolt 32 is provided with a shoulder 42 which bears against the corresponding abutment 44 in the rear mold half 30B when the bolt is inserted to its desired position for the molding or casting operation.

With the mold assembly held as shown, wax or other similar material is poured into the sprue 39 to fill the mold cavity completely. Prior to so doing, a solid cylinder 48 is mounted by appropriate screws 50 to one of the mold halves so that the latter cylinder is aligned centrally in the cylindrical portion 52 of the mold cavity which is to define the hosel, whereby the hosel will be formed by the wax material penetrating between cylinder 48 and the adjacent walls of the mold cavity.

After the mold and its contents of wax have cooled to solidify the wax, the bolt 32 is screwed back out of the mold cavity and the mold halves are removed, as shown in FIG. 11, to produce the wax-like image 53 of the ultimate golf club shown in FIGS. 12 and 13, including the internal threads 54 of wax. It will be understood that known techniques of molding and casting may be applied during the above-described process, and since they are part of the prior art they need not be described in detail.

Figure 15:
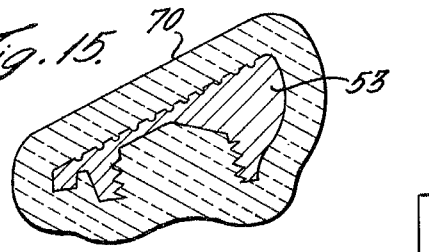
FIG. 15 is a sectional view taken along lines 15—15 of FIG. 14, showing the coated wax-like image of a golf club head after the process depicted in FIG. 14.
Figure 16:
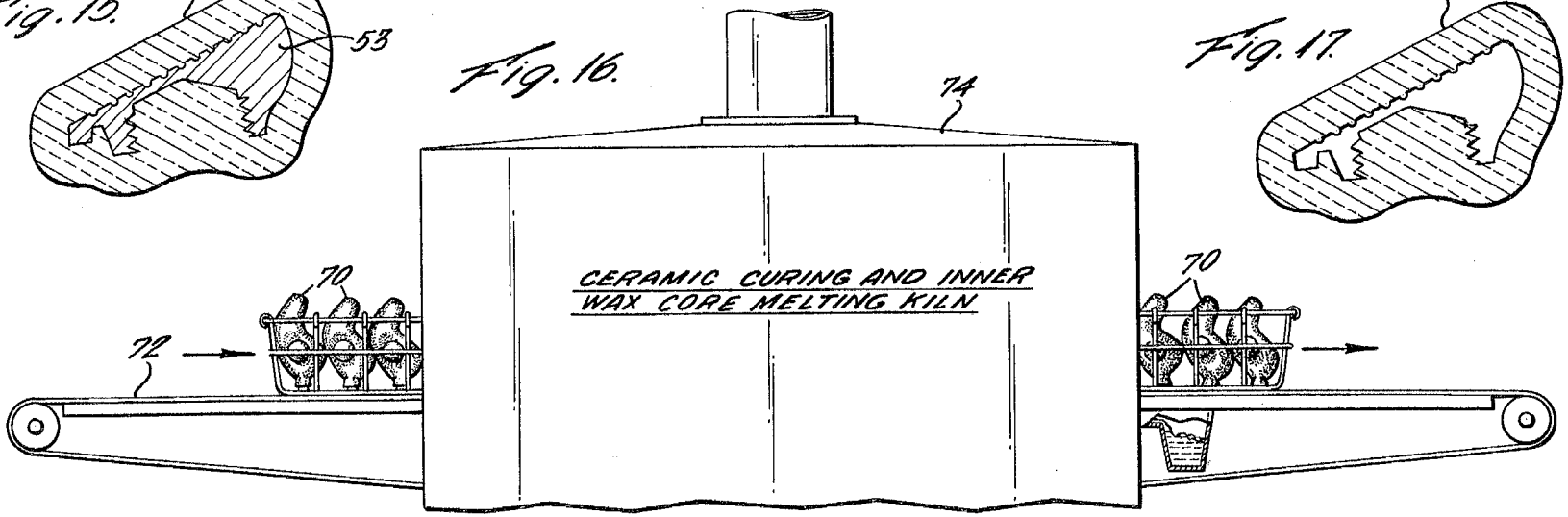
FIG. 16 is a schematic representation of an apparatus for further hardening the coating, and for melting and removing the wax.

The wax-like image 53 of the golf club shown in FIG. 12 may then be suitably suspended on a travelling belt 50 as shown in FIG. 14, along with similar wax-like images of the other golf clubs to be made, so that it is carried into and out of one or more baths 60, 62 of a liquid coating material such as a flowable or liquid ceramic material, after which they may be removed from the belt and temporarily stored as shown at 66; if desired, this dipping process may be done by hand. At this point the wax-like image 53 bears on its exterior the frangible coating 70, as shown in FIG. 15, and may be conveyed on a suitable conveyor 72 through a ceramic curing and inner wax core melting kiln 74 (FIG. 16) in an inverted position such that the melted wax inside the coating will drain out, and the ceramic coating will become cured to form a hard mold, and rendered brittle and easily frangible.

Figure 17:
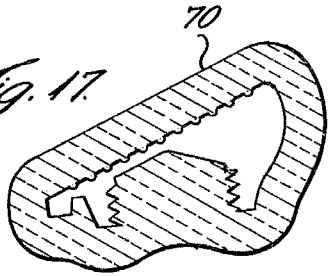
FIG. 17 is a transverse sectional view of a frangible mold produced by the apparatus of FIG. 15.

The resultant ceramic mold 70 shown in section in FIG. 17 is then ready to receive the molten metal in final casting of the ultimate golf club head, which may be accomplished by conventional methods of pouring molten metal, preferably stainless steel, into the ceramic mold through the ceramic sprue, allowing it to cool and harden, and then striking the frangible mold to crack it and remove it, leaving the desired club head, which is then polished to final form. Lead plug or insert 22, appropriately threaded on its exterior, is then screwed into the internal threads of the cast club head to provide the golf club as illustrated in FIGS. 1–8 hereof. The length and hence weight of the lead insert may be selected for the preferences of the individual user of the golf club.

While the invention has been described with reference to specific embodiments thereof in the interest of complete definiteness, it will be understood that it may be embodied in a variety of form diverse from those specifically shown and described, without departing from the spirit and scope of the invention as defined by the appended claims.

What is claimed is:

1. In a method of making a golf club head having a lead insert positioned therein directly behind the center of the intended striking surface of said head, comprising:

providing a split mold assembly which, when assembled for casting, defines a first mold cavity of the same configuration as said golf club head;

filling said cavity with a molten wax-like material, and thereafter cooling said mold assembly to solidify said wax-like material in the form of a wax-like image of said golf club head;

separating said split mold assembly to release said wax-like image from said split mold assembly, and then forming on said removed wax-like image a frangible coating of material;

thereafter, melting said wax-like material within said coating and withdrawing it from within said coating to leave a second mold cavity in said coating of the same configuration as said golf club head;

filling said second mold cavity with molten metal;

cooling said molten metal in said second mold cavity to permit it to solidify and form said golf club head; and thereafter removing said frangible coating from said formed golf club head.

the improvement comprising:

during said forming of said wax-like image, providing an externally-threaded protrusion on said split mold assembly in a postion such that the threaded portion of said protrusion extends into said first mold cavity forwardly from the rear side thereof, thereby to form an internally-threaded recess extending into the rear surface of said wax-like image when it has solidified;

after said solidifying of said wax-like image and before covering it with said coating material, unscrewing said threaded protrusion from said wax-like image to leave exposed said internal threads in said recess in said wax-like image, whereby said internal threads are replicated in said golf club head; and after said cooling of said molten metal to form said club head and after said frangible coating is removed, screwing an insert comprising lead into said internal threads thereof.

2. The method of claim 1, wherein said metal is stainless steel, said coating is formed by dipping said wax-like image in a liquid bath of said material, and said protrusion comprises an externally-threaded bolt screwed into said first mold cavity to a position adjacent to, but spaced inwardly from, the front portion of said split mold assembly.

* * * * *